US008814098B2

(12) United States Patent
Hastilow et al.

(10) Patent No.: US 8,814,098 B2
(45) Date of Patent: Aug. 26, 2014

(54) CONTROL SYSTEM FOR A TRACTION WING

(75) Inventors: David Robert Hastilow, Hong Kong (CN); Patrick Stuart Goodman, Tuen Mun (HK)

(73) Assignee: Neil Pryde Limited, Tuen Mun, New Territories (HK)

( * ) Notice: Subject to any disclaimer, the term of this patent is extended or adjusted under 35 U.S.C. 154(b) by 422 days.

(21) Appl. No.: 13/162,729

(22) Filed: Jun. 17, 2011

(65) Prior Publication Data

US 2011/0309199 A1 Dec. 22, 2011

(30) Foreign Application Priority Data

Jun. 17, 2010 (HK) ..... 10106054.8

(51) Int. Cl.
*B64C 31/00* (2006.01)
*B63B 35/79* (2006.01)

(52) U.S. Cl.
CPC ..... *B63B 35/7979* (2013.01)
USPC ..... 244/155 A; 114/39.16

(58) Field of Classification Search
CPC B63B 35/7979; B63B 35/7993; B64C 31/00; B64C 31/06; B64C 31/028; B64C 2031/00
USPC ..... 244/4 A, 155 R, 155 A; 114/39.16, 39.18
See application file for complete search history.

(56) References Cited

U.S. PATENT DOCUMENTS

| | | | | |
|---|---|---|---|---|
| 6,273,369 | B1 | 8/2001 | Nishimura et al. | |
| 6,513,759 | B2 | 2/2003 | Starbuck | |
| 6,514,115 | B2 | 2/2003 | Harich | |
| 6,581,879 | B2 | 6/2003 | Bellacera | |
| 6,691,954 | B1 * | 2/2004 | Harrington et al. | 244/155 A |
| 6,830,220 | B2 | 12/2004 | Runyan | |
| 6,869,047 | B2 | 3/2005 | Pouchkarev | |
| 6,877,697 | B2 * | 4/2005 | Bellacera | 244/155 A |
| 6,988,694 | B2 | 1/2006 | Barrs et al. | |
| 7,036,771 | B1 | 5/2006 | Pouchkarev | |
| 7,413,146 | B2 * | 8/2008 | Quijano | 244/155 A |
| 7,581,701 | B2 * | 9/2009 | Logosz et al. | 244/155 A |
| 7,971,829 | B2 * | 7/2011 | See et al. | 244/155 A |
| 2012/0049006 | A1 * | 3/2012 | Logosz et al. | 244/155 A |

FOREIGN PATENT DOCUMENTS

| | | |
|---|---|---|
| EP | 1 302 398 A2 | 4/2003 |
| EP | 1 569 726 B1 | 9/2005 |
| FR | 2 762 583 A1 | 10/1998 |

* cited by examiner

*Primary Examiner* — Rob Swiatek
(74) *Attorney, Agent, or Firm* — Leydig, Voit & Mayer, Ltd.

(57) ABSTRACT

A control system for a traction wing or a surfing kite includes a bar that is gripped by a person carried in the wind by the wing or kite. Fixtures on the opposed ends of the bar are connected to respective lines that are attached to the wing. A central line attached to the wing passes through a hole located in the bar and divides into two lines that are connected to the user. A grip slides along the central line and the grip is biased toward the bar.

11 Claims, 3 Drawing Sheets

CONTROL SYSTEM FOR A TRACTION WING

TECHNICAL FIELD

The present invention relates to a control system for a traction wing that is controllable in direction and angle of attack and which is may be used in sports such as kite surfing.

BACKGROUND OF THE INVENTION

The control system generally used on this type of wing comprises a rigid bar to each end of which is fixed a "rear line", so-called for its remote end being connected to the wing behind its centre of pressure, and a single central line bifurcating into two lines called "front lines" for their remote ends being attached in front of the centre of pressure of the wing. The lower end of the central line is fixed to the user, as to a harness, and the bar slides along the single central line. Pivoting the bar to the left and right changes the direction of the wing, while extending and retracting the bar respectively decreases and increases the angle of attack of the wing relative to the wind, and thus regulates its power. A control system of this type is described, for instance, in FR2762583.

During use, for any given position of the bar along the central line it is desirable to be able to trim the wing, to provide for some variation of its angle of attack depending upon the wind conditions. This control system can be provided with means for adjusting the length of the central line to achieve this trim function. A trim adjustment strap arrangement may include fasteners and cooperating straps provided with two grips, such that pulling one grip shortens the central line from an initial length, and pulling the other grip releases the strap, allowing the central line to return to its initial length. The grips may be disposed on a mount that is fixed to the central line, such that they are positioned for ready access by the user.

However, fastening a grip mount to the centre line in a position which allows for ready trim adjustment can compromise the sliding movement of the bar along the centre line, as the bar abuts the mount. As a user could be towed into obstacles by wind gusts, the ability to quickly move the bar to a fully extended position is important as it allows a rapid reduction in power. In addition, in current designs the position of the grips can be pulled toward the user by adjustment of the trim and this can lead to tangling of the trim lines with other control lines. It will be understood therefore, that there is a need for a control system which addresses these requirements. The present invention proposes to address this need, or more generally, to provide an improved control system for a traction wing.

DISCLOSURE OF THE INVENTION

To this effect, in one aspect the invention provides a control system for a traction wing comprising:

a bar with a fixture at each end thereof for connection to a respective rear line;

a transverse aperture through the bar;

a central line for connection to the user through the transverse aperture, the central line bifurcating into two front lines;

at least one grip mounted to slide along the central line and actuable to vary the length of the central line for trim adjustment, and resilient means for urging the grip toward the bar.

By resiliently mounting the grip in the manner of the invention the resilient means urges the grip toward a position where it can be readily reached by the user, but the ability to extended the bar along the central line is not compromised as it can be moved against the action of the resilient means.

The fixtures may compromise one or more apertures, protrusions, or the like, to which the rear lines can be connected directly, or via fasteners.

The central line may comprise one or more flexible lines or components connected, in series or parallel to form the central line.

Preferably the control system further comprises a mount for holding the at least one grip, the mount having an opening configured to slidingly receive the central line.

Preferably the resilient means comprises at least one resilient member, such as an elastomeric block or spring. Preferably the resilient means comprises a helical spring through which the central line extend. Preferably the spring has a longitudinal end fixed to the mount.

In another aspect the invention provides a control system for a traction wing comprising:

a bar with a fixture at each end thereof for connection to a respective rear line;

a transverse aperture through the bar;

a central line for connection to the user through the transverse aperture, the central line bifurcating into two front lines;

the central line having an fitting at a proximate end for connection to the user, and resilient means for urging the bar toward the fitting.

In this alternative embodiment the resilient means just acts on the bar to urge it towards the user. In light wind conditions the traction forces generated by the wing are low and the resilient means keeps the kite powered up by urging the bar towards the user. In stronger wind conditions the traction forces on the kite increase, overcoming the spring force and moving the bar away from the user thus depowering the wing. So in this embodiment the resilient means may provide automatic power regulation (when the bar is not gripped by the user) to control the power of the wing in fluctuating wind conditions. This can be used as both a convenience feature for example when untwisting lines, as a safety feature or both.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
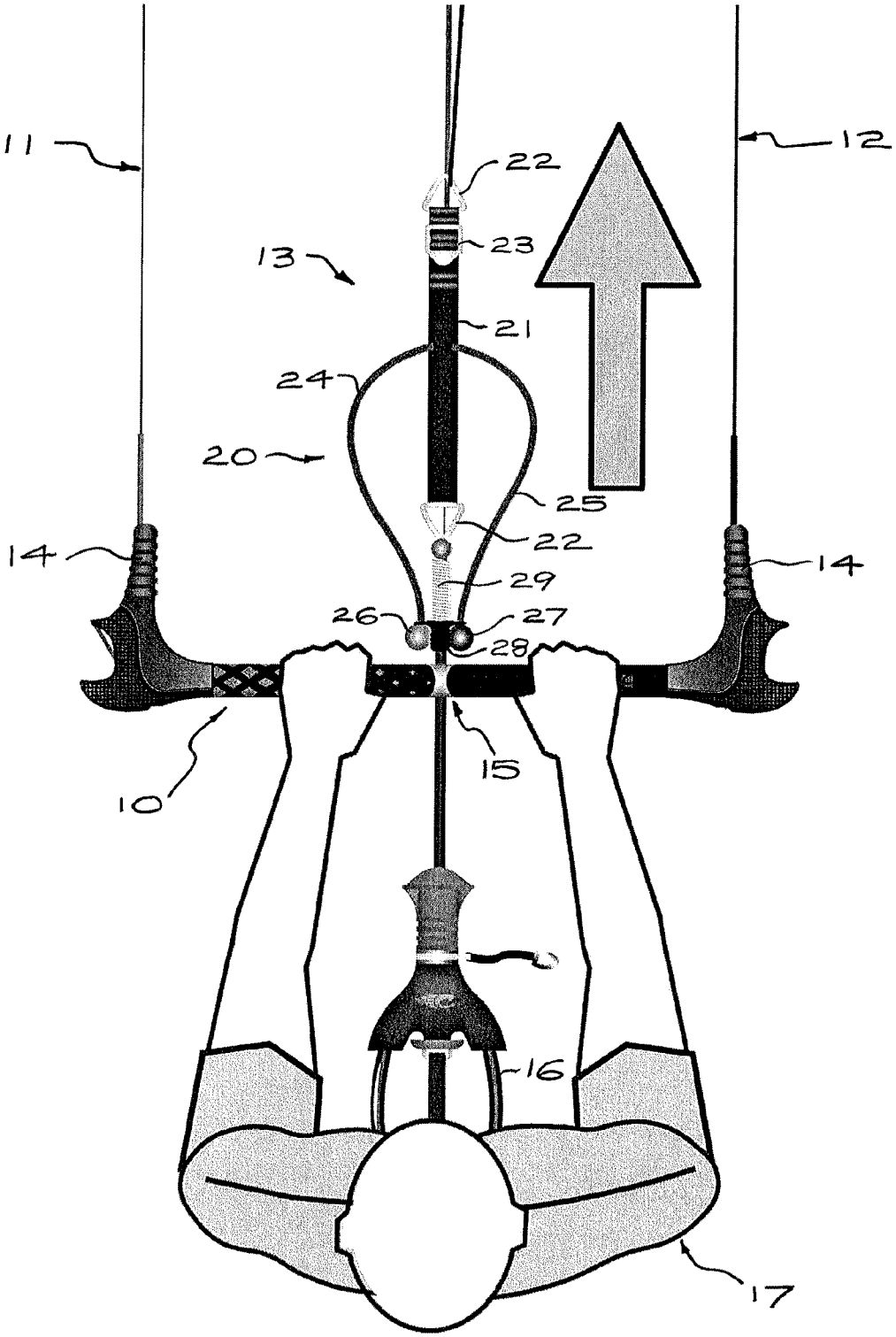
FIGS. 1-3 are schematic plan views of a control system of the invention in use.

Referring to the drawings, a control system for a traction wing generally includes a bar 10, two rear lines 11, 12 and a central line 13. At each end of the bar 10 is a fixture 14 shown connected to a respective rear line 11, 12, the remote ends of the rear lines being connected to the wing (not shown). Disposed at a midpoint along the bar is a transverse aperture 15 through which the central line 13 extends. At the proximal end of the central line is a harness loop 16 for connecting the central line 13 to a harness (not shown) worn by the user 17. The central line 13 bifurcates into two front lines (not shown) connected to the wing.

A trim assembly 20 includes part of the central line 13 and includes an adjustment strap 21 spanning two triangular links 22 and a fastener 23 engaged with the strap 21. First and second trim straps 24, 25 are provided to vary the length of the central line 13 for trim adjustment. Ball-shaped grips 26, 27 are disposed on the ends of each of the trim straps 24, 25. By pulling on the first grip 26, the adjustment strap 21 is pulled through the fastener 23 to shorten the central line 13 from an initial length, and pulling the second grip 27 releases the adjustment strap 21 allowing the central line 13 to return to its initial length. A mount 28 has a central opening in which the central line 13 is slidingly received, and openings on opposing sides for receiving respective trim straps 24, 25, thereby mounting the grips 26, 27 to the central line.

Figure 2:
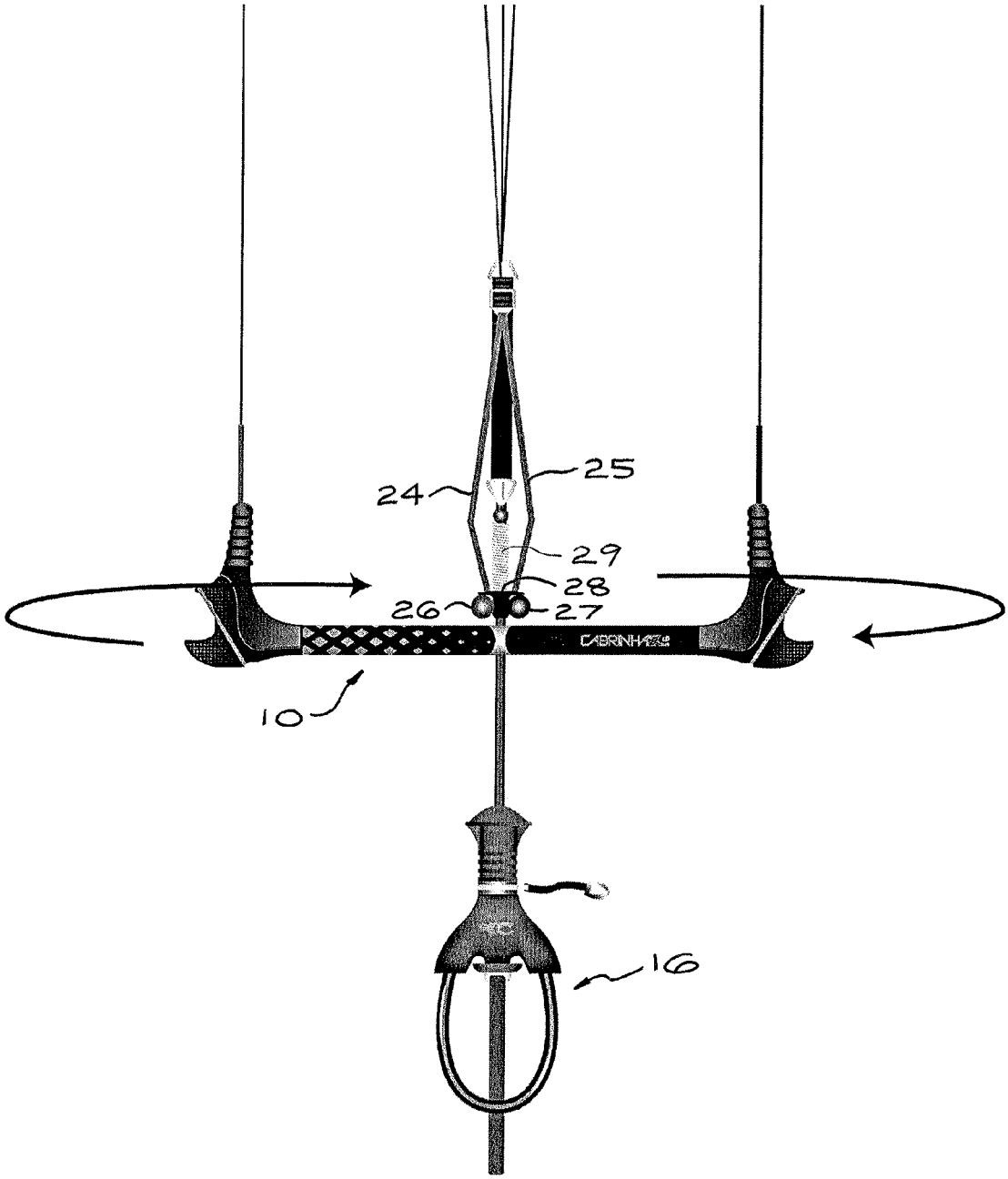
Figure 3:
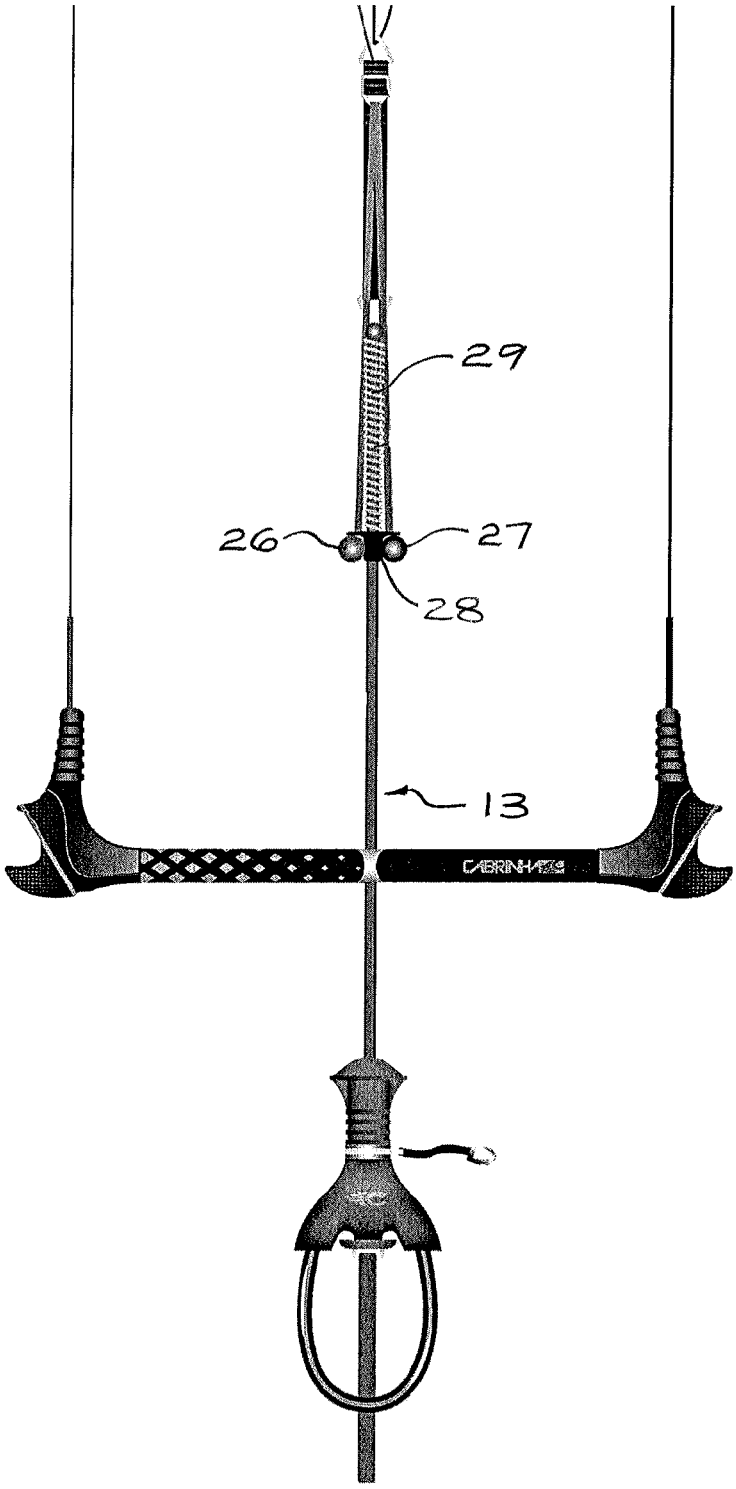

Longitudinally opposing ends of a helical spring 29 are connected to the mount 28 and the link 22, and the central line 13 extends axially through the spring. FIG. 3 shows the spring in its relaxed state, where it serves to hold the mount 28 and attached grips 26, 27 at a position spaced apart from the harness loop 16 for ready access by the user, while allowing the bar 10 to slide along the plain section of the central line 13 in front of the harness loop 16. From FIGS. 2 and 3 it can be seen that, by extending the bar 10 to abut the mount 28, the spring 29 is compressed and urges the mount 28 and attached grips 26, 27 toward the bar 10, so even if displaced by movement of the bar 10, the grips return to a position where they can be readily reached.

Aspects of the present invention have been described by way of example only and it should be appreciated that modifications and additions may be made thereto without departing from the scope thereof.

The invention claimed is:

1. A control system for a traction wing comprising:

a bar having opposed first and second ends;

first and second fixtures respectively located at the first and second ends of the bar for connection to respective rear lines;

a transverse aperture through the bar;

a central line for connection to a user of the control system and passing through the transverse aperture, the central line bifurcating into two front lines;

at least one grip mounted on and sliding along the central line, the at least one grip being actuable to vary length of the central line for trim adjustment; and resilient means for urging the at least one grip toward the bar.

2. The control system of claim 1 further comprising a mount for holding the at least one grip, the mount having an opening slidingly receiving the central line.

3. The control system of claim 2 wherein the resilient means comprises at least one resilient member.

4. The control system of claim 3 wherein the resilient means comprises a helical spring through which the central line extends.

5. The control system of claim 4 wherein the spring has a longitudinal end fixed to the mount.

6. The control system of claim 1 wherein the resilient means comprises at least one resilient member.

7. The control system of claim 6 wherein the resilient means comprises a helical spring through which the central line extends.

8. A control system for a traction wing comprising:

a bar having opposed first and second ends;

first and second fixtures respectively located at the first and second ends of the bar for connection to respective rear lines;

a transverse aperture through the bar;

a central line having a proximal end for connection to a user of the control system, wherein the central line passes through the transverse aperture, bifurcates into two front lines, and has a distal end opposite the proximal end;

a fitting located at the proximal end of the central line for connection to the user; and resilient means located between the distal end of the central line and the transverse aperture for urging the bar toward the fitting.

9. The control system of claim 8 wherein the resilient means comprises a helical spring through which the central line extends.

10. The control system of claim 8 wherein the fitting comprises a harness loop.

11. The control system of claim 10 wherein the resilient means comprises a helical spring through which the central line extends.

* * * * *